US008967156B1

(12) United States Patent
Skidmore

(10) Patent No.: US 8,967,156 B1
(45) Date of Patent: Mar. 3, 2015

(54) APPARATUS AND METHOD FOR SELECTIVE HAIR COLORING

(76) Inventor: Marysia Skidmore, Oakland Park, FL (US)

( * ) Notice: Subject to any disclaimer, the term of this patent is extended or adjusted under 35 U.S.C. 154(b) by 0 days.

(21) Appl. No.: 13/556,824

(22) Filed: Jul. 24, 2012

Related U.S. Application Data

(63) Continuation-in-part of application No. 12/584,731, filed on Sep. 11, 2009, now abandoned.

(51) Int. Cl.

| | |
|---|---|
| ***A45D 19/02*** | (2006.01) |
| ***A45D 24/24*** | (2006.01) |
| ***A45D 19/00*** | (2006.01) |
| ***A45D 24/22*** | (2006.01) |

(52) U.S. Cl.
CPC ..... *A45D 19/0008* (2013.01); *A45D 24/22* (2013.01)
USPC ..... 132/112; 132/116; 132/150

(58) Field of Classification Search
CPC ..... A45D 24/22; A45D 24/24
USPC ..... 132/112–116, 125, 147, 108, 150, 270, 132/901, 109, 110, 161
See application file for complete search history.

(56) References Cited

U.S. PATENT DOCUMENTS

| | | | | |
|---|---|---|---|---|
| 3,424,176 | A * | 1/1969 | Hale | 132/112 |
| 3,818,917 | A | 6/1974 | Hudson | |
| 4,522,215 | A | 6/1985 | Verducci | |
| 4,566,472 | A * | 1/1986 | Mueller et al. | 132/112 |
| 4,691,720 | A * | 9/1987 | Schmitz | 132/112 |
| 5,146,936 | A * | 9/1992 | Ng | 132/208 |
| 6,779,220 | B1 | 8/2004 | Raffa | |

* cited by examiner

*Primary Examiner* — Robyn Doan
(74) *Attorney, Agent, or Firm* — Lhota & Associates, P.A.; David P. Lhota, Esq.

(57) ABSTRACT

A coloring comb for applying a coloring material to selected strands of hair on a head includes a number of teeth, each of which has a trough-shaped reservoir extending along its upper surface and a slot extending from its tip through the elongated reservoir. The reservoirs are filed through elongated slots in an applicator plate held on the coloring comb.

10 Claims, 8 Drawing Sheets

APPARATUS AND METHOD FOR SELECTIVE HAIR COLORING

CROSS REFERENCE TO RELATED APPLICATIONS

This application is a continuation-in-part of application Ser. No. 12/584,731 filed Sep. 11, 2009

FEDERALLY SPONSORED RESEARCH OR DEVELOPMENT

Not Applicable

BACKGROUND OF THE INVENTION

1. Field of the Invention

This invention relates to an apparatus and a method for hair coloring, and, more particularly to such an apparatus and such a method by which a coloring material is applied only to certain portions of the hair, with a coloring comb being used to divide the hair into strands, some of which are treated using the coloring material.

2. Summary of the Background Art

Methods for hair coloring have been used since ancient times, when materials such as henna, indigo, sage, and chamomile were used. In the Roman Empire, dark haired women who admired the blonde hair of female slaves imported from northern Europe lightened their own hair using saffron, red arsenic, nut shells, and plant ash. In the latter part of the Nineteenth Century, synthetic dyes came into use for hair coloring, and hydrogen peroxide came into widespread use as a bleaching agent.

While it is relatively easy to change the color of a person's hair as a whole by dyeing or bleaching, the results of applying such a process uniformly to all of the hair are generally disappointing, which the hair acquiring an uninteresting uniform color. Therefore, such a process is generally followed by another step, in which selected portions of the hair are lightened, in a process known as streaking, or darkened, in a process known as reverse streaking.

The method most commonly used today for coloring selected portions of the hair is the foil method, in which the stylist isolates a strand of hair to lie along the upper surface of a sheet of foil having an edge held against the head near the roots of the strand of hair. (As the term is used herein, a strand of hair is a bundle of individual hair shafts, all of which have roots in a small section of the scalp.) The selected strand is then treated by the application of coloring material, being isolated from adjacent portions of the hair with the foil, and the foil is then folded around the strand to continue providing a barrier preventing migration of the coloring material to other parts of the hair during time necessary to provide the desired treatment.

One problem with the foil method arises from the cost of the large number of foil sheets that must be used to treat the hair of an individual and from the space required for their disposal or the costs of recycling the material. The time required for the completion of the process is also disadvantageous in its effects on the cost of the process and on the discomfort of the individual whose hair is being treated. Furthermore, since the strands of hair being treated are covered by the foil, it is difficult for the stylist using this method to track the progress of the treatment, often resulting, for example, in the overbleaching of certain strands of hair being streaked.

Before the strands of hair can be placed on individual foil panels and treated with coloring materials, the hair must be separated into strands. For example, this is done by weaving the hair using an ordinary rattail comb, having an comb section with ordinary teeth from which a pointed extension, or rattail, extends. The comb section is used to shape each strand, and the strands are individually placed to extend across alternating sides of the rattail, in a woven fashion.

The patent literature includes a number of descriptions of hair weaving combs having various features facilitating this hair weaving process. For example, one such comb includes a set of legs extending from an elongate support member, with distal end portions of the legs including hair separating teeth for separating a section of hair into sub-sections. When the legs of the comb are initially inserted into a section of hair, the teeth create sub-sections of hair. When the legs are further inserted in the section of hair, the teeth group and displace alternate hair subsections away from other alternate hair sub-sections. The other alternate hair sub-sections are bypassed by the teeth and slide into hair-receiving slots formed between the spaced-apart legs of the hair weaving comb. When the legs are still further inserted through the hair section, the displaced hair sub-sections are pushed out of a hair-stylist's hand and readily fall out of the teeth of the distal end of the comb and down to the head of the customer.

An alternative hair weaving comb includes teeth with a single hook located in the forward inside edge of each tooth. When the teeth are drawn through the hair the hooks engage multiple uniformly spaced strands of hair in a single movement. Another hair weaving comb includes an elongated panel at one end for supporting foil and hair during a coloring procedure or other treatment. The panel comprises a comb portion on one side thereof with a curved tooth at the end of the panel adjacent to the comb portion. A handle portion is secured to the panel and is tapered inwardly toward the other end of the tool. An elongated pick extends outwardly from the handle portion at the other end of the tool for separating, weaving and preparing hair to be colored or treated. Yet another hair weaving comb includes features facilitating the application of hair coloring materials, in the form of a concave spoon-shaped depression adjacent to the comb teeth for holding the coloring material and a rounded end for spreading the material into the hair.

The patent literature additionally includes a number of descriptions of coloring combs for treating selected strands of hair by means of coloring material fed through enclosed channels formed within the spine of the comb and extending to openings at roots of the comb between certain adjacent teeth of the comb. As the comb is moved through the hair, strands flowing between these certain adjacent teeth are treated with the coloring material, while strands following between other adjacent teeth are not treated. These combs additionally include reservoirs holding the coloring material and a pumping mechanism that the stylist can use to supply material through the channels to the openings between teeth within the comb. In some of these devices, the reservoir is a flexible member that can be squeezed to provide a pumping action.

For example, a coloring comb may be formed as an elongated tube having a plurality of spaced-apart groups of teeth, with an opening between each pair of adjacent teeth within each of the groups, and with a channel within the elongated tub connected the openings between adjacent teeth to a squeeze bottle holding a coloring material. As this comb is moved through the hair, strands of hair flowing through the groups of teeth are treated, while strands of hair flowing within spaces between the groups of teeth are not treated. A frosting comb may be formed by connecting holes between adjacent teeth with a hand-pumped reservoir filled with coloring material, with the rate of flow of material through the holes being controlled by an adapter plate having a first plurality of metering holes aligned with the holes within the comb and a second plurality of holes fitting over the teeth.

An alternative apparatus for hair dyeing can be formed by providing a comb having teeth extending from one side of a spine, while spaced-apart tufts of bristles extend from the other side, along with an applicator that is removably clipped onto the spine of the comb. The applicator includes a tubular member with a channel connecting a squeeze bottle to a plurality of nozzles disposed between certain of the tufts of the bristles.

A disadvantage of such hair coloring combs arises from the fact that the combs need to be cleaned between customers, sometimes between the application of different hair coloring materials to a single customer, and otherwise as required to keep coloring material from drying within the comb. The channels or tubes extending between the reservoir and holes through which the coloring material is applied to the hair make this necessary cleaning difficult. Furthermore, the requirement that the coloring material must flow through such channels or tubes generally limits the coloring combs to use with a liquid coloring material. What is needed is an apparatus for the selective coloring of hair that is easy to use and clean, and that can be used with hair coloring of hair that is easy to use and clean, and that can be used with hair coloring paste materials.

SUMMARY OF THE INVENTION

In accordance with one aspect of the invention, hair coloring apparatus, including a coloring comb, is provided. The coloring comb includes a spine, a handle extending from an end of the spine, and a plurality of spaced-apart teeth, each extending in a common direction from the spine. Each of the teeth includes a trough-shaped reservoir extending along the tooth, having an opening extending along an upper surface of the tooth, and a slot extending between the trough-shaped reservoir and a lower surface of the tooth bifurcating the tooth.

Preferably, the surfaces within each tooth forming the slot within the tooth, spaces between adjacent teeth, and outer edges of outermost teeth within the plurality of teeth, and lower surfaces of each tooth are tapered to extend to points at each side of the central slot at the tip of the tooth. Preferably, each trough-shaped reservoir includes a lip extending upward to form the opening extending along the upper surface of the tooth, with the lip being bifurcated by the slot at an end of the reservoir adjacent the tip of the tooth.

The apparatus preferably additionally includes an applicator plate removably held on the coloring comb in a preferred position, in which a plurality of elongated slots extending through the applicator plate extends above openings in the trough-shaped reservoirs of the coloring comb. The applicator plate additionally includes a pallet extending between and around the plurality of elongated slots to form a portion of an upper surface of the applicator plate For example, the pallet is a flat surface surrounded by a ridge. Preferably, the applicator plate additionally includes a lower surface having a recessed area extending around each to the elongated slots so that the lip extending around each trough-shaped reservoir is disposed within the recessed area with the applicator plate being held on the coloring comb in the preferred position. Preferably, the applicator plate additionally includes a handle extending from the pallet.

In accordance with another aspect of the invention, a method for applying hair coloring material to selected strands of hair on a head is provided, with the method comprising: placing an applicator plate in a preferred position on a coloring comb to align elongated slots within the applicator plate with trough-shaped reservoirs extending along teeth within the coloring comb; pushing the hair coloring material through the elongated slots into the reservoirs; removing applicator plate from the coloring comb; and moving the coloring comb through the hair so that certain strands flow through the spaces between teeth in the comb, while other strands flow through slots extending within teeth of the coloring comb. A single slot extends from a tip of each tooth through an elongated reservoir within the tooth. These steps may be repeated to apply coloring material to selected strands of hair on various parts of the head, with the hair coloring process being completed with or without the application of heat. The use of foils to wrap the individual strands of hair is not required.

BRIEF DESCRIPTION OF THE DRAWINGS

These and other aspects of the invention will become apparent by reference to the following detailed description and to the associated drawings, in which.

DETAILED DESCRIPTION OF THE INVENTION

Figure 1:
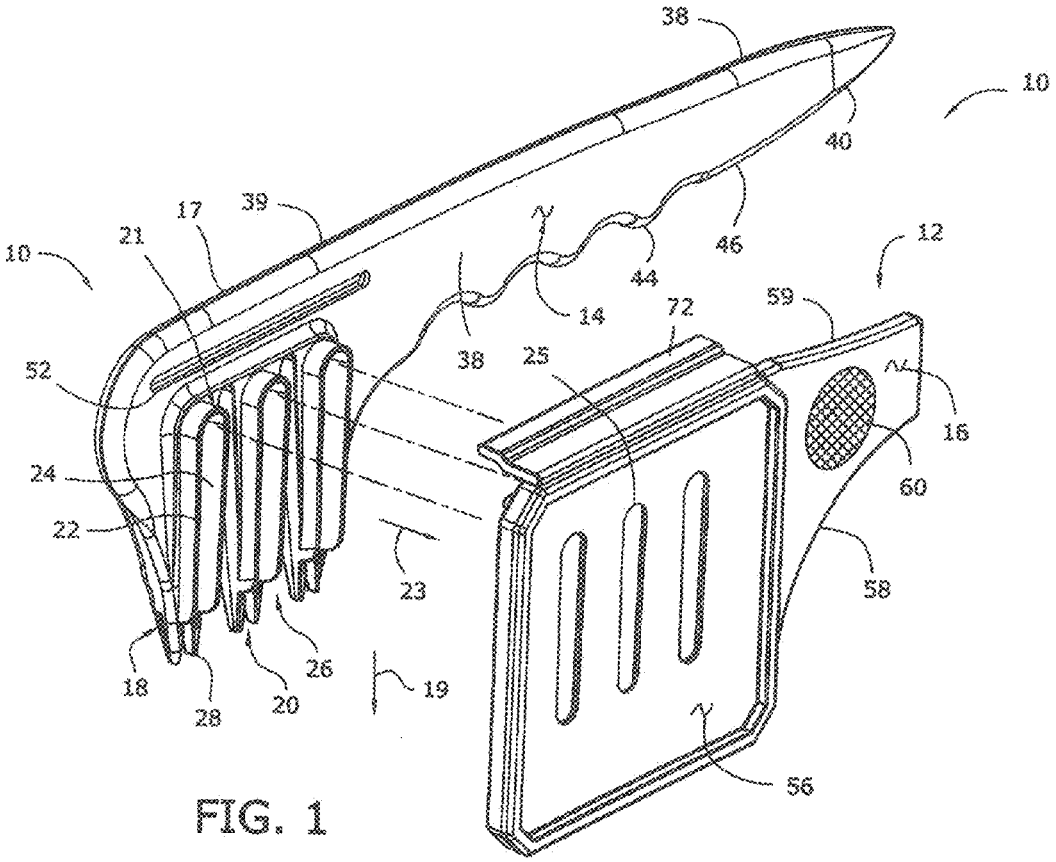
FIG. 1 is a perspective view showing upper surfaces of a coloring comb and an applicator plate built in accordance with the invention and shown in an exploded relationship with one another.

With reference to the drawings, FIGS. 1-10 depict the preferred and alternative embodiments of the instant invention 10. FIG. 1 is a perspective view of a coloring comb 10 and an applicator plate 12, both built in accordance with the invention, with the applicator plate 12 being shown in an exploded relationship with the coloring comb 10, and with the perspective view being taken to show an upper surface 14 of the coloring comb 10 and an upper surface 16 of the applicator plate 12. The coloring comb 10 includes a spine 17, from which three teeth 18 extend in a common direction indicated by arrow 19. Each of the three teeth 18 includes a central slot 20 and a trough-shaped reservoir 21 in fluid communication with the central slot 20. The trough-shaped central reservoir 21 includes a lip 22 extending upward, in the direction of arrow 23, to an opening 24. The applicator plate 12 includes three elongated slots 25. (While it is understood that the coloring comb 10 and the applicator plate 12 are hand-held devices that can readily be held in any orientation, upper and lower surfaces and corresponding directional indications, such as "upward" or 'downward," are specified herein for clarity and consistency without an intention to imply that the devices 10, 12 must be held or used in a specific orientation.)

When the applicator plate 12 is held against the coloring comb 10 in a preferred position, the three elongated slots 25 are held in alignment with the three trough-shaped reservoirs 21, so that a hair coloring paste material can be introduced easily into the trough-shaped reservoirs 21 through the elongated slots 25. Then, the applicator plate 12 is separated from the coloring comb 10, and the coloring comb 10 is run through the customer's hair to apply the coloring material to strands of hair flowing through the central slots 20 in the three teeth 18, while strands of hair flowing through the spaces 26 between the teeth 18 are not treated with the coloring material.

Figure 2:
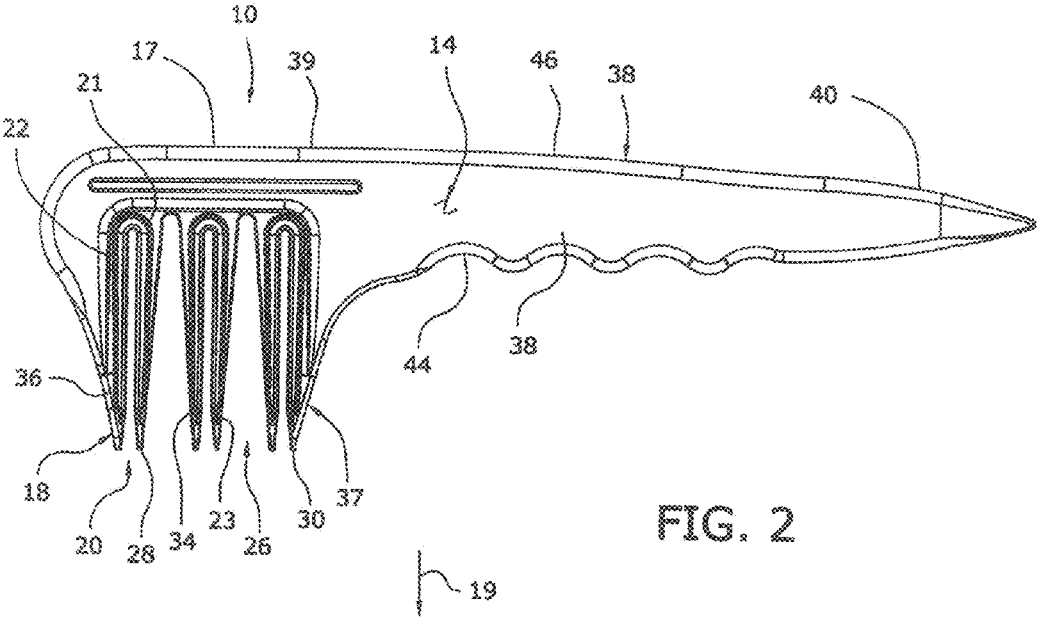
FIG. 2 is a plan view of the coloring comb of FIG. 1.

FIG. 2 is a plan view of the coloring comb 10, showing the upper surface 14 thereof. Within each of the teeth 18, the central slot 20 extends along and within the trough-shaped reservoir 21, being open at a distal end 28 of the tooth 18 to allow strands of hair to enter the central slot 20. The tooth 18 and the trough-shaped reservoir 21, including its surrounding lip 22 is thus bifurcated by the central slot 20, forming distal points 30, from which internal surfaces 32 of the tooth 18 forming the central slots 20 therein, outer surfaces 34 of the tooth 18 forming the spaces 26 between the teeth 16, and outer surfaces 36 of the outermost teeth 37 are tapered. This configuration allows the teeth 18 to be easily pushed into the hair, with strands of hair being separated by the distal points 30 to flow within the central slots 20 and the spaces 26 between the teeth 18.

The coloring comb 10 additionally includes a handle 38 extending from an end 39 of the spine 17 to a tapered end 40, of the handle 38, and a scalloped surface 44 configured to facilitate gripping the handle 38 by the fingers of the stylist. A peripheral surface 46 of the coloring comb 10 is rounded to facilitate the handling of the comb 10 and its movement along the hair of the customer.

Figure 3:
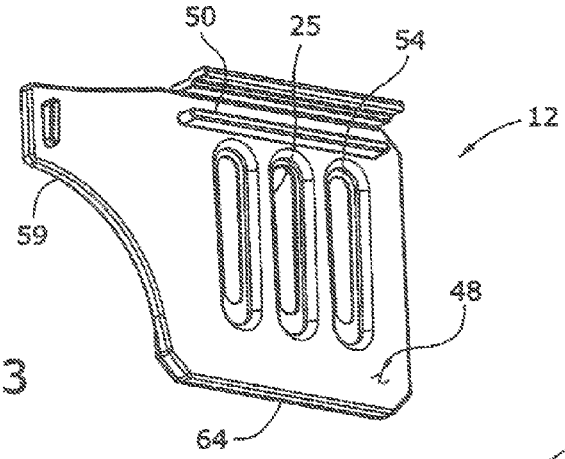
FIG. 3 is a perspective view of the applicator plate of FIG. 1, showing a lower surface thereof.

FIG. 3 is a perspective view of the applicator plate 12, showing a lower surface 48 thereof. Referring to FIGS. 1 and 3, an elongated bar 50 projecting from the lower surface 48 of the applicator plate 12 extend to engage slot 52 in the upper surface 14 of the coloring comb 10, with the applicator plate 10 in the preferred position additionally aligning the elongated slots 25 of the applicator plate 10 with the trough-shaped reservoirs 21 of the coloring comb 10. The lower surface 48 of the applicator plate 10 additionally includes a recessed area 54 extending around each of the elongated slots 25, into which the lip 22 of a trough-shaped reservoir 21 of the coloring comb 10 moves as the applicator plate 12 is brought into the preferred position on the coloring comb 10. The instant invention 10 also includes projecting spacers 54 and a ledge 72.

Continuing to refer to FIG. 1, the upper surface 16 of the applicator plate 12 additionally includes a pallet surface 56, extending around the elongated slots 25 and surrounded by a ridge 58. Hair coloring paste material may be placed on the pallet surface 56 to be pushed through the elongated slots 25 as space within the trough-shaped reservoirs 21 of the coloring comb 10 attached to the applicator plate 12 becomes available to hold the paste. The upper surface 16 additionally includes a handle 59 with a textured surface 60, which facilitates handling the applicator plate 12 with two fingers without touching hair coloring paste on the pallet surface 56.

Figure 4:
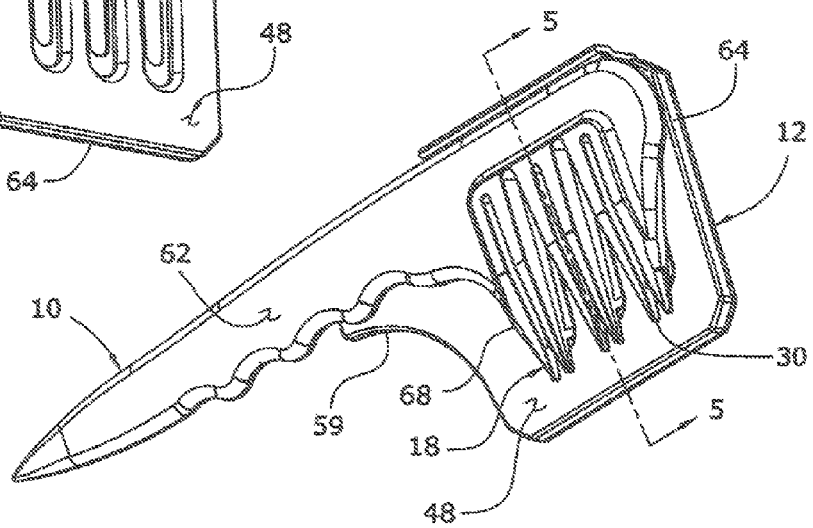
FIG. 4 is a perspective view showing lower surfaces of the coloring comb and applicator plate of FIG. 1, attached to one another.

FIG. 4 is a perspective view of the coloring comb 10 and the applicator plate 12, shown as held on one another in the preferred position, with a lower surface 62 of the coloring comb 10 and a portion of the lower surface 48 of the applicator plate 12 being shown. The applicator plate 12 extends beyond the teeth 18 of the coloring comb 10 so that the applicator plate 12 can be easily handled by flattened edge surfaces 64 to install the applicator plate 12 therefrom.

Figure 5:
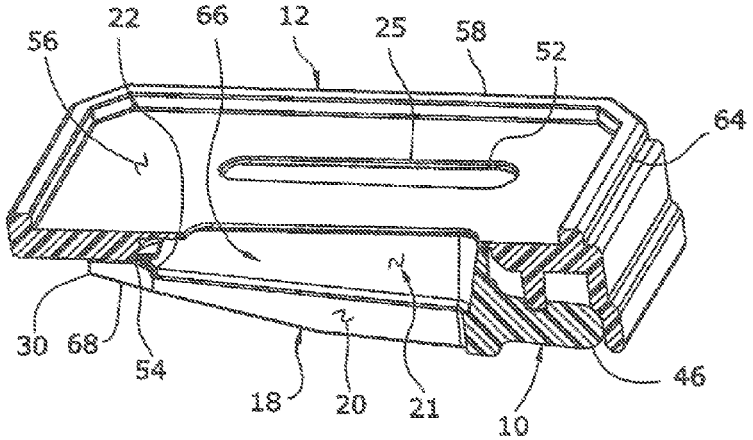
FIG. 5 is a fragmentary cross-sectional perspective view of the coloring comb and applicator plate of FIG. 1, attached to one another, taken as indicated by section lines 5-5 in FIG. 4.
Figure 6:
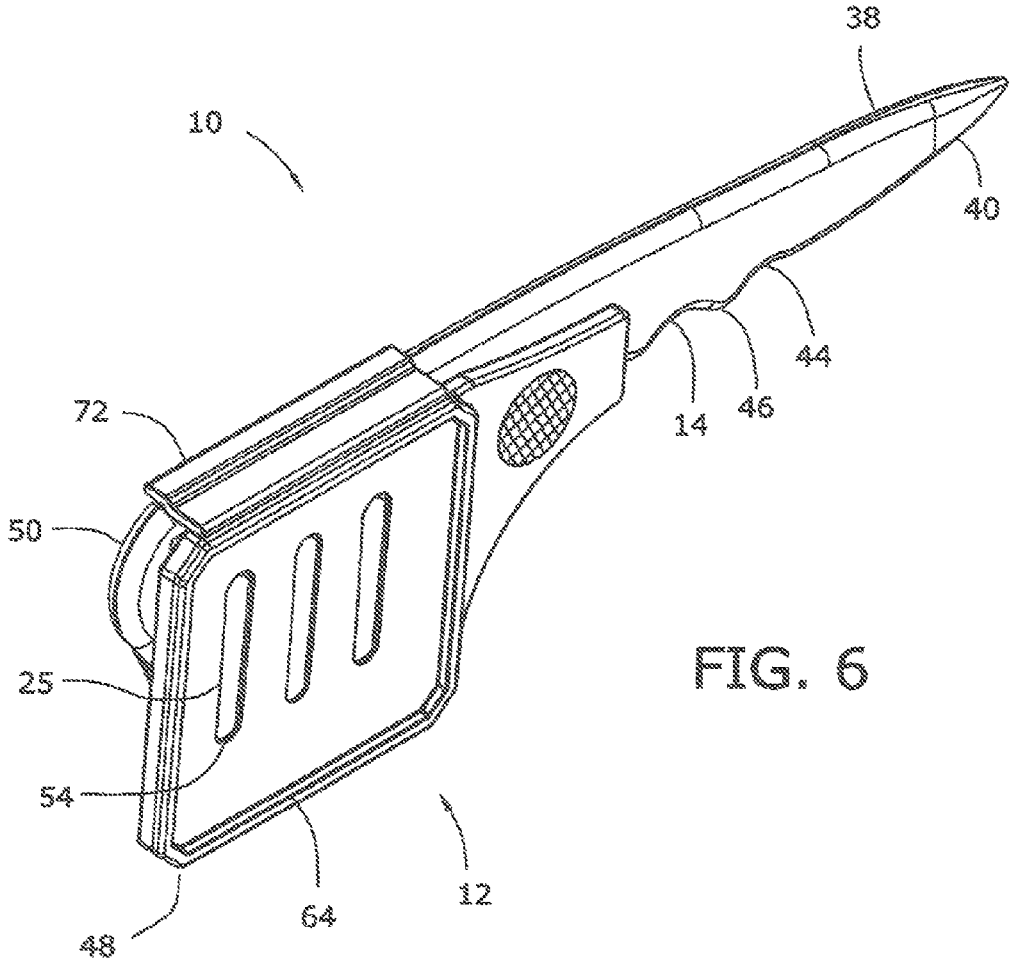
FIG. 6 is a perspective view of the instant invention.
Figure 7:
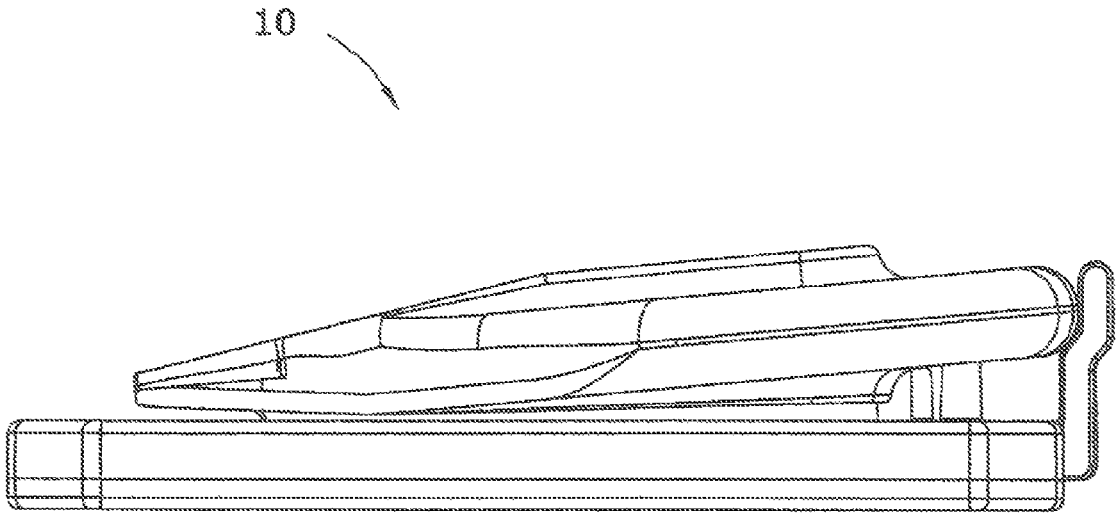
FIG. 7 is a side perspective view of the instant invention.
Figure 8:
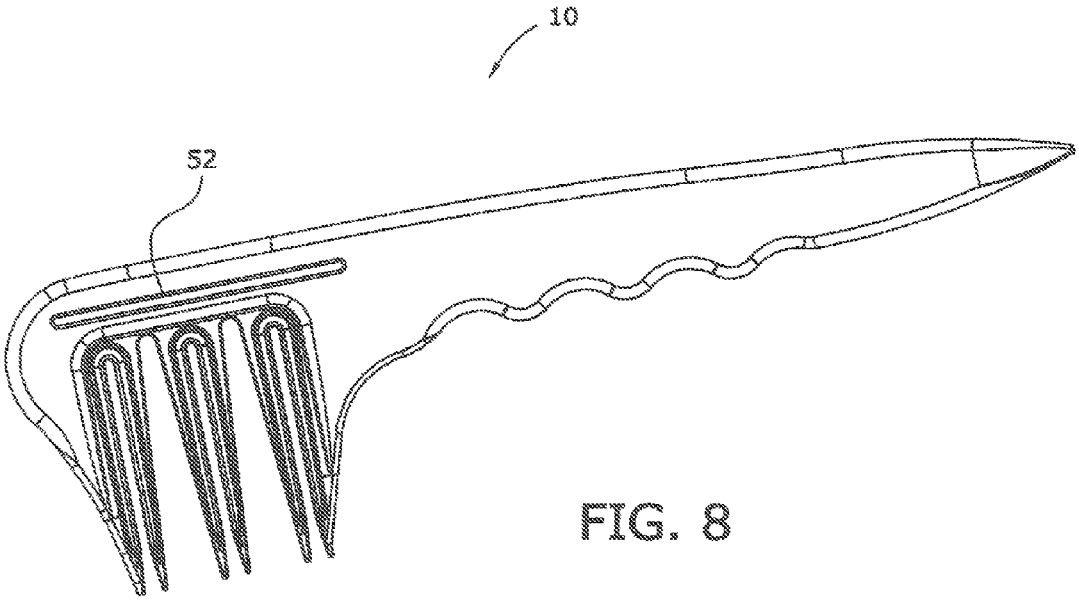
FIG. 8 is another side perspective view of the instant invention.
Figure 9:
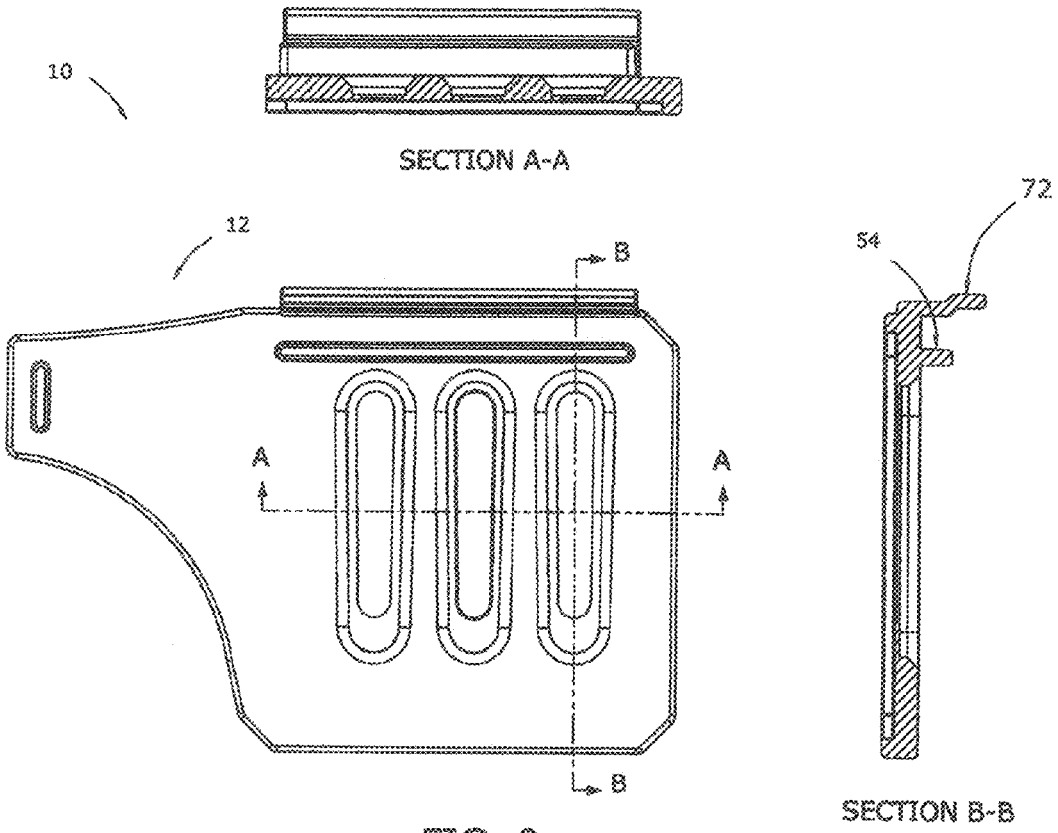
FIG. 9 is a mechanical diagram of the instant invention.
Figure 10:
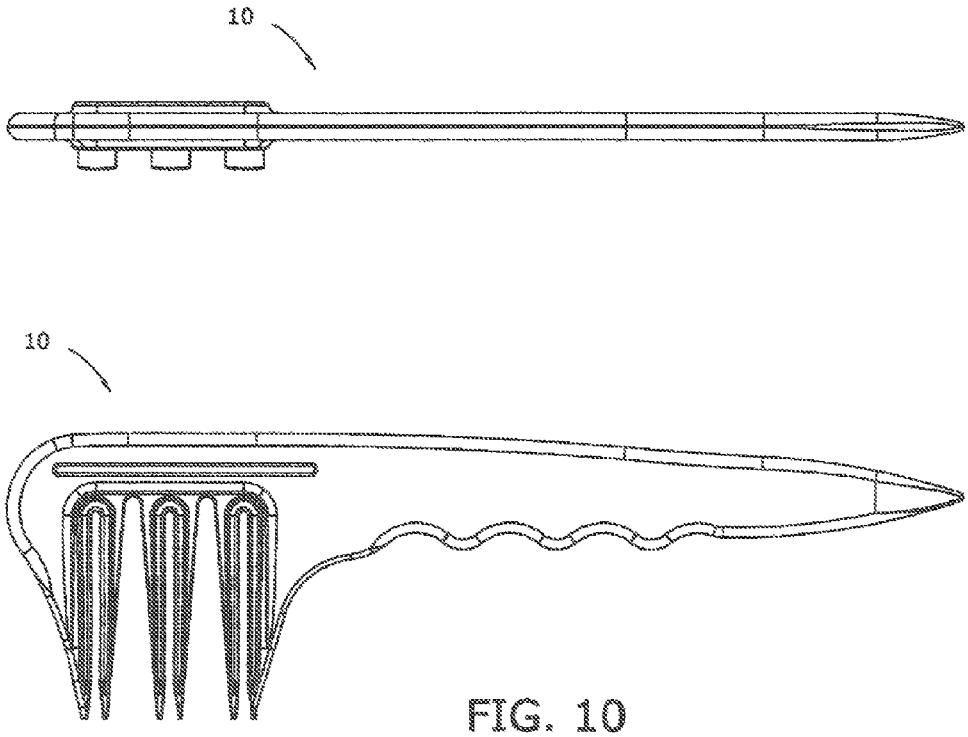
FIG. 10 is another mechanical diagram of the instant invention.

FIG. 5 is a fragmentary cross-sectional perspective view of the coloring comb 10 and the applicator plate 12, again shown as attached to one another in the preferred position, taken as indicated by section lines 5-5 in FIG. 4. The lips 22 of the trough-shaped reservoirs 21 extend into the recessed areas 54 around the elongated slots 25 of the applicator plate 12, with fluid communication being established between the pallet surface 56 of the applicator plate 12 and spaces 66 formed by the trough-shaped reservoirs 21 and the central slots 20 of the coloring comb 10.

As shown in FIGS. 4 and 5, each of the teeth 18 of the coloring comb 10 includes tapered lower surfaces 68 extending to the points 30 to facilitate the entry of the teeth 18 into the hair of the customer, with the applicator plate 12 having been removed from the coloring comb 10.

The process of using the hair coloring comb to apply hair coloring material selected strands of hair is repeated to color hair in various places on the head. The process of coloring is then repeated with or without the application of heat to hair. Since a coloring paste is used, there is no need to use foils to prevent migration of the hair coloring material to adjacent strands of hair, resulting in significant savings in time and money.

While the invention has been described in terms of preferred embodiments with some degree of particularity, it is understood that his description has been given only as an example, and that many variations can be made without departing from the spirit and scope of the invention, as described in the appended claims.

What is claimed is:

1. Hair coloring comb apparatus, said apparatus comprising:

a spine having an inside surface;

a handle extending from said spine;

a plurality of spaced apart rigid and brushless teeth, wherein each tooth in the plurality of spaced-apart teeth extends in a common direction from said spine to a tip of the tooth, and wherein each of the teeth comprises an upper surface, a lower surface, and a tough-shaped reservoir defined by a raised lip projecting from said upper surface along at least a portion of said tooth and having an opening extending along and between said upper surface and said lower surface, and an open-ended central slot extending between said tip of the tooth, trough-shaped reservoir, said upper surface and said lower surface, said central slot bifurcating said tooth;

an applicator plate having an aperture corresponding to each said reservoir and an elongated bar projecting from an inner surface of said plate opposing said spine inner surface and above each said aperture in said applicator plate; and an elongated slot defined in said handle for receiving said bar to align said applicator plate apertures with said trough-shaped reservoirs.

2. The apparatus of claim 1, wherein said handle comprises:

a scalloped surface defining a plurality of finger grooves.

3. The apparatus of claim 2, wherein said handle comprises:

a single pointed distal end.

4. The apparatus of claim 1, wherein said handle comprises:

a rounded peripheral edge.

5. The apparatus of claim 1, wherein said applicator plate further comprises:

a ledge extending inward from said applicator plate for resting over a top edge of said spine.

6. The apparatus of claim 1, wherein said applicator plate further comprises:

a pallet surface extending around said apertures for receiving hair coloring paste of varying colors to be applied simultaneously through said apertures.

7. The apparatus of claim 6, wherein said applicator plate further comprises:

a ridge projecting from pallet surface and surrounding said applicator plate apertures.

8. The apparatus of claim 1, wherein said applicator plate extends below said teeth when attached to said spine.

9. The apparatus of claim 1, wherein said lips of said spine extend into said applicator plate apertures when said applicator plate is mounted to said spine.

10. The apparatus of claim 1, wherein said teeth are tapered.

* * * * *